US010960522B2

(12) United States Patent
Yamaguchi et al.

(10) Patent No.: US 10,960,522 B2
(45) Date of Patent: Mar. 30, 2021

(54) TIGHTENING TOOL

(71) Applicant: KYOTO TOOL CO., LTD., Kyoto (JP)

(72) Inventors: Yoshiyuki Yamaguchi, Kyoto (JP); Yuki Okawa, Kyoto (JP); Yoshiharu Matsumoto, Kyoto (JP)

(73) Assignee: KYOTO TOOL CO., LTD., Kyoto (JP)

( * ) Notice: Subject to any disclaimer, the term of this patent is extended or adjusted under 35 U.S.C. 154(b) by 278 days.

(21) Appl. No.: 16/114,289

(22) Filed: Aug. 28, 2018

(65) Prior Publication Data

US 2019/0061123 A1 Feb. 28, 2019

(30) Foreign Application Priority Data

Aug. 29, 2017 (JP) ..... JP2017-164255

(51) Int. Cl.
*B25B 23/142* (2006.01)

(52) U.S. Cl.
CPC ..... *B25B 23/1425* (2013.01); *B25B 23/1427* (2013.01)

(58) Field of Classification Search
CPC ..... B25B 23/142; B25B 23/1422; B25B 23/1425; B25B 23/1427; B25B 23/147; B25B 13/5016
See application file for complete search history.

(56) References Cited

U.S. PATENT DOCUMENTS 6,119,562 A * 9/2000 Jenkins ..... B25B 23/1427 81/479
6,276,243 B1 * 8/2001 Jenkins ..... B25B 23/1425 81/479

(Continued)

FOREIGN PATENT DOCUMENTS

CN 205290790 U 6/2016
CN 103963000 B 11/2016

(Continued)

OTHER PUBLICATIONS

Chinese Office Action in corresponding Chinese Application No. 201810990063.4, dated Mar. 13, 2020.

(Continued)

*Primary Examiner* — David B. Thomas
(74) *Attorney, Agent, or Firm* — Bacon & Thomas, PLLC

(57) ABSTRACT

The tightening tool includes: a main body configured to be able to be held by a worker and including a turn detector; a head having an approximately rod shape and provided in the main body, which can engage with a tightened member; a head pin configured to pivotally support the head in the main body to turn the main body with respect to the head; and a spring configured to restrict the main body from turning with respect to the head by a compressive force in a longitudinal direction of the head. When a tightening torque reaches a preset torque value, the turn detector is released from restriction by the spring to turn around the head pin in a first direction and then turn in a second direction, and therefore detects turns of the main body with respect to the head in the first direction and the second direction.

4 Claims, 10 Drawing Sheets

(56) References Cited

U.S. PATENT DOCUMENTS

| | | | | |
|---|---|---|---|---|
| 6,526,853 | B2 * | 3/2003 | Jenkins | B25B 23/1425 81/479 |
| 7,878,076 | B2 * | 2/2011 | Lucke | B25B 23/1425 73/862.23 |
| 8,171,828 | B2 * | 5/2012 | Duvan | B25B 13/462 81/479 |
| 9,669,527 | B2 * | 6/2017 | Ho | B25B 23/1427 |
| 10,525,573 | B2 * | 1/2020 | Yamaguchi | B25B 23/1425 |
| 2007/0227316 | A1 | 10/2007 | Lucke et al. | |
| 2010/0265097 | A1 | 10/2010 | Obatake et al. | |
| 2012/0234569 | A1 | 9/2012 | Lawton et al. | |
| 2016/0031070 | A1 | 2/2016 | Ball | |
| 2016/0279770 | A1 | 9/2016 | Yokoyama et al. | |

FOREIGN PATENT DOCUMENTS

| | | | |
|---|---|---|---|
| EP | 0 723 839 | A1 | 7/1996 |
| JP | 2008-307670 | A | 12/2008 |
| JP | 2014-037041 | A | 2/2014 |
| TW | M340896 | | 9/2008 |
| TW | 201131995 | A1 | 9/2011 |
| TW | 201406502 | A | 2/2014 |
| TW | 201702017 | A | 1/2017 |
| TW | I573671 | B | 3/2017 |

OTHER PUBLICATIONS

Taiwanese Office Action in corresponding Taiwanese Application No. 107130029, dated Apr. 24, 2019.

* cited by examiner

TIGHTENING TOOL

CROSS-REFERENCE TO RELATED APPLICATIONS

The present application claims priority from Japanese Patent Application No. 2017-164255 filed on Aug. 29, 2017, the entire contents of which are hereby incorporated by reference.

BACKGROUND

1. Technical Field

The present invention relates to a tightening tool.

2. Related Art

A torque wrench has been known as a tightening tool to control a tightening torque. The torque wrench is configured to notify a worker that a tightening torque generated by tightening a tightened member such as a bolt and a nut at a tightening point reaches a torque value previously set for the tightening tool (hereinafter "preset torque value").

In the case of a mechanical torque wrench, when the tightening torque reaches a preset torque value, which is applied by the worker who is holding a casing as a main body of the torque wrench to tighten the tightened member, the casing is turned around a head pin pivotally supporting a head and the casing in a first direction which is the same as the tightening direction to tighten the tightened member. In this case, the head contacts a portion such as the casing and therefore produces a clicking noise and a vibration which can be perceived by the worker. By this means, the worker knows that the tightening torque reaches the preset torque value. After that, when the worker stops applying the force to the torque wrench, the casing turns in a second direction opposite to the first direction (tightening direction), and returns to the initial position. Some mechanical torque wrenches may change the preset torque value by rotating a dial rotating member to adjust the compressive force of a spring.

Here, in order to detect a turning motion of the casing with respect to the head of the mechanical torque wrench, a technology for detecting a turning motion of the head has been disclosed, for example, in Japanese Patent Application Laid-Open Nos. 2014-37041 and 2008-307670. In these disclosures, a detector having, for example, a microswitch, a permanent magnet and a hall element, is used to detect a turning motion of the head.

However, with the above-described technologies, it is possible to only detect whether the head is turned, but is not possible to accurately detect the turning motion of the casing with respect to the head, such as the amount of turn, the turn direction, and the turn angle of the case with respect to the head.

SUMMARY OF THE INVENTION

It is desirable to provide a tightening tool capable of accurately detecting the turning motion of a main body configured to be turned with respect to a head in the first direction and the second direction by the operation of the worker.

An aspect of the present invention provides a tightening tool including: a main body configured to be able to be held by a worker and including a turn detector; a head having an approximately rod shape and provided in the main body, the head being able to engage with a tightened member; a head pin configured to pivotally support the head in the main body to turn the main body with respect to the head; and a spring configured to restrict the main body from turning with respect to the head by a compressive force in a compressive direction which is the same as a longitudinal direction of the head. When a tightening torque for tightening the tightened member reaches a preset torque value, the turn detector is released from restriction by the spring to turn around the head pin in a first direction and then turn in a second direction, and therefore detects turns of the main body with respect to the head in the first direction and the second direction.

The tightening tool may further include a tool condition determination unit configured to determine a condition of deterioration of the spring, based on a turn of the main body detected by the turn detector.

The turn detector may include a light emitter configured to emit light, and a light receiver configured to receive the light from the light emitter, and detect the turn of the main body based on variation in a light receiving state of the light receiver.

The turn detector may include a light reception varying unit configured to turn in synchronization with a motion of the main body to vary the light receiving state of the light receiver.

The turn detector may include a first turn detector configured to detect a turn of the main body in the first direction, and a second turn detector configured to detect a turn of the main body in the second direction.

The tightening tool may further include a torque value setting unit configured to be able to set the preset torque value to a predetermined value by rotating a rotating member to change the compressive force of the spring.

According to the present invention, the tightening tool can accurately detect the turning motion of the main body configured to be turned with respect to the head in the first direction and the second direction by the operation of the worker.

DETAILED DESCRIPTION

Hereinafter, an embodiment of the tightening tool according to the present invention will be described with reference to the drawings. With the present embodiment, a mechanical torque wrench will be described as an example of tightening tools configured to notify the worker that the tightening torque reaches a preset torque value by producing a clicking noise and a vibration perceived by the worker. In the case of the mechanical torque wrench, when the tightening torque reaches the preset torque value by tightening the tightened member, a casing is turned around a head pin pivotally supporting the casing and a head in a first direction which is the same as the tightening direction to tighten the tightened member. In this case, the casing is turned in the first direction and contacts a portion such as the head and therefore produces a clicking noise and a vibration which can be perceived by the worker. By this means, the worker is notified that the tightening torque reaches the preset torque value. Then, the worker stops applying the force to the torque wrench in response to the notice from the torque wrench. When the tightening torque is reduced to a value equal to or lower than the preset torque value, the casing of the mechanical torque wrench turns in a second direction (loosening direction) opposite to the first direction, and returns to the initial position.

In addition, as other examples of the mechanical torque wrench, there is a so-called prelock torque wrench which needs a tool for setting a torque value operated by the worker to change the preset torque value, and a so-called preset torque wrench which allows the preset torque value to be changed by the operation of the worker without any tool.

<Configuration of Torque Wrench>

Figure 1:
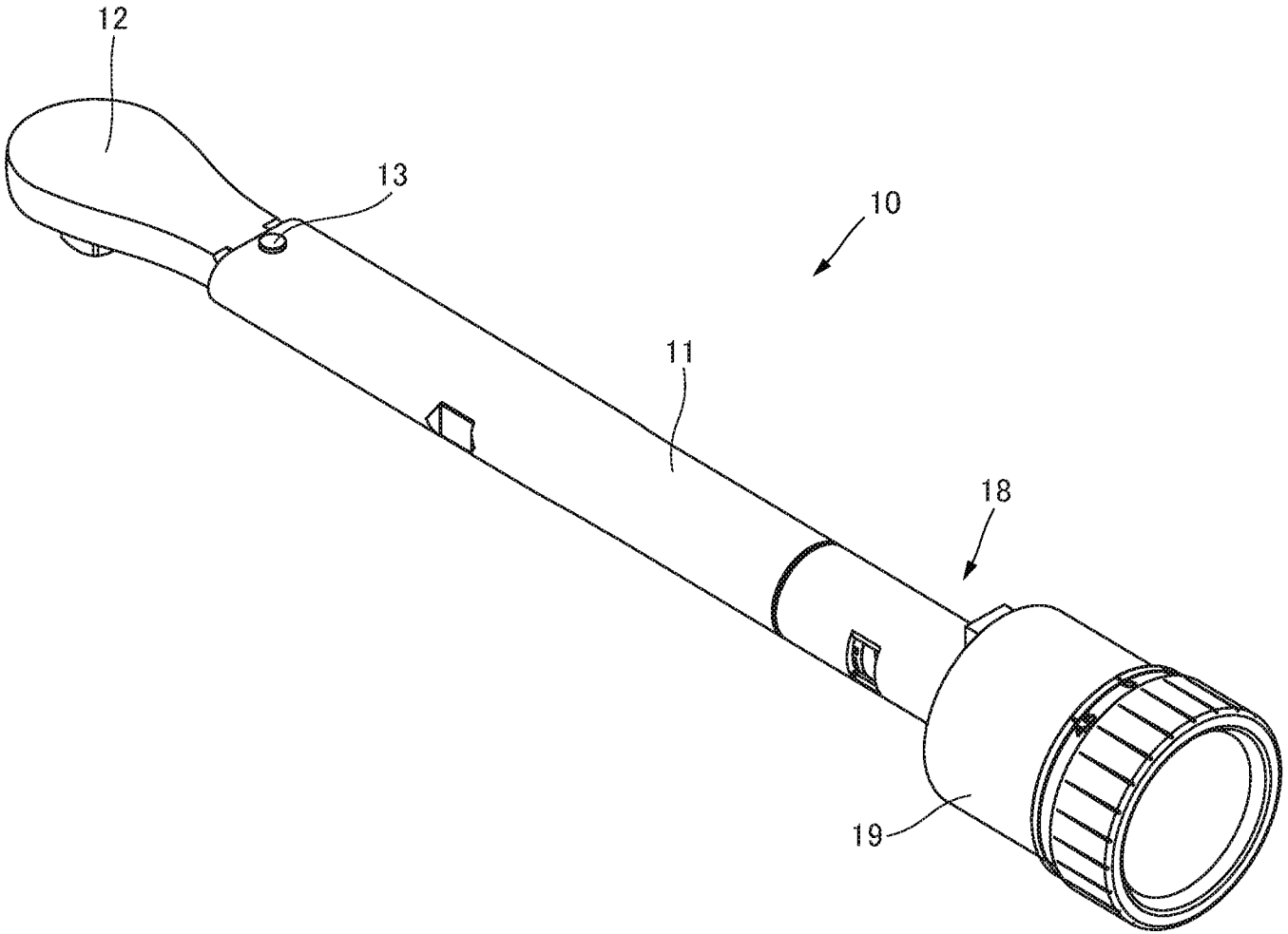
FIG. 1 is a perspective view illustrating a torque wrench as a tightening tool according to an embodiment of the present invention.
Figure 2:
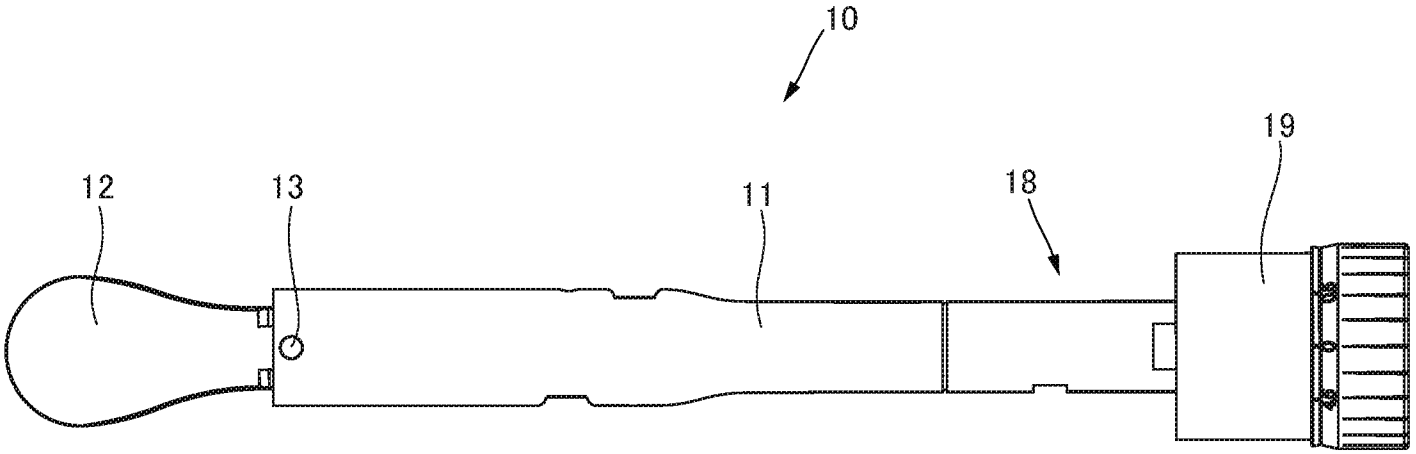
FIG. 2 is a front view illustrating the torque wrench illustrated in FIG. 1.

FIG. 1 is a perspective view illustrating a torque wrench 10 as a tightening tool according to an embodiment of the present invention. FIG. 2 is a front view of the torque wrench 10.

As illustrated in FIGS. 1 and 2, the torque wrench 10 is a mechanical preset torque wrench as described above. The torque wrench 10 includes a casing 11, a head 12, a head pin 13, a torque value setting unit 18, a rotation angle detector 19 and so forth. When the head 12 contacts the casing 11 due to a torque generated by a tightening operation, the torque wrench 10 produces a clicking noise and a vibration which can be perceived by the worker to notify the worker that the tightening torque reaches the preset torque value.

The casing 11 having an approximately cylindrical shape is configured to accommodate components of the torque wrench 10 such as the head 12, and form the outer shape of the torque wrench 10. The casing 11 forming the outer shape of the torque wrench 10 may be referred to as "main body." The head 12 is provided at one end (first end) of the casing 11 In addition, the torque value setting unit 18 and the rotation angle detector 19 are provided at the other end (second end) of the casing 11. The second end of the casing 11 functions as a grip held by the worker when the worker (user) performs a tightening operation by using the torque wrench 10. Here, a grip (not illustrated) made of resin may be integrally or detachably attached to the casing 11. Meanwhile, the casing 11 may be held directly by the worker to function as a grip.

Figure 3:
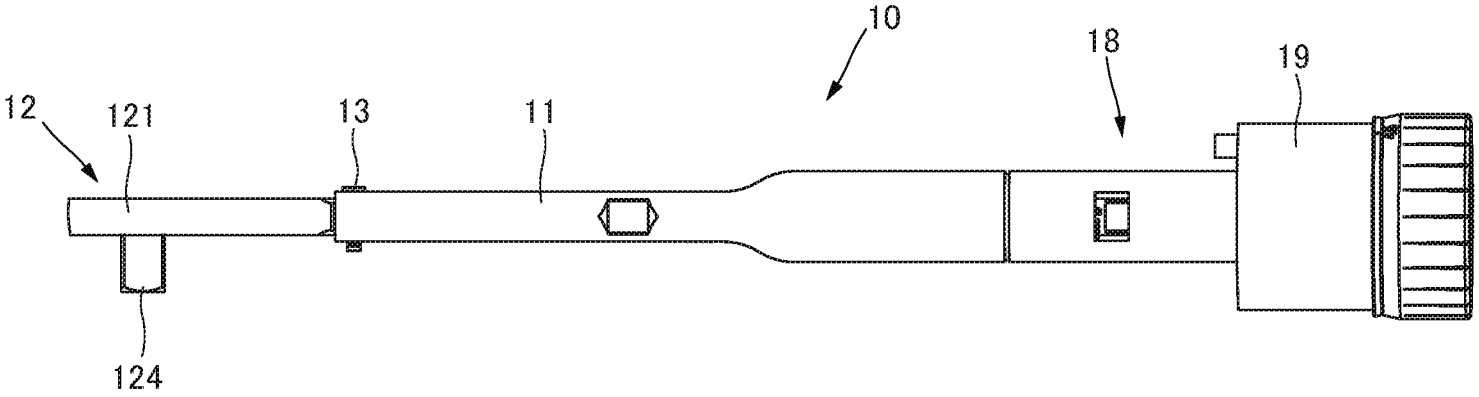
FIG. 3 is a bottom view illustrating the torque wrench illustrated in FIG. 1.

FIG. 3 is a bottom view illustrating the torque wrench 10. As illustrated in FIG. 3, the head 12 includes a ratchet head 121. The ratchet head 121 is exposed from the casing 11. When the tightened member is a bolt or nut, the ratchet head 121 is provided with a socket connector 124 to allow a socket wrench (not illustrated) engaging with the tightened member to be detachably attached to the ratchet head 121.

Figure 4:
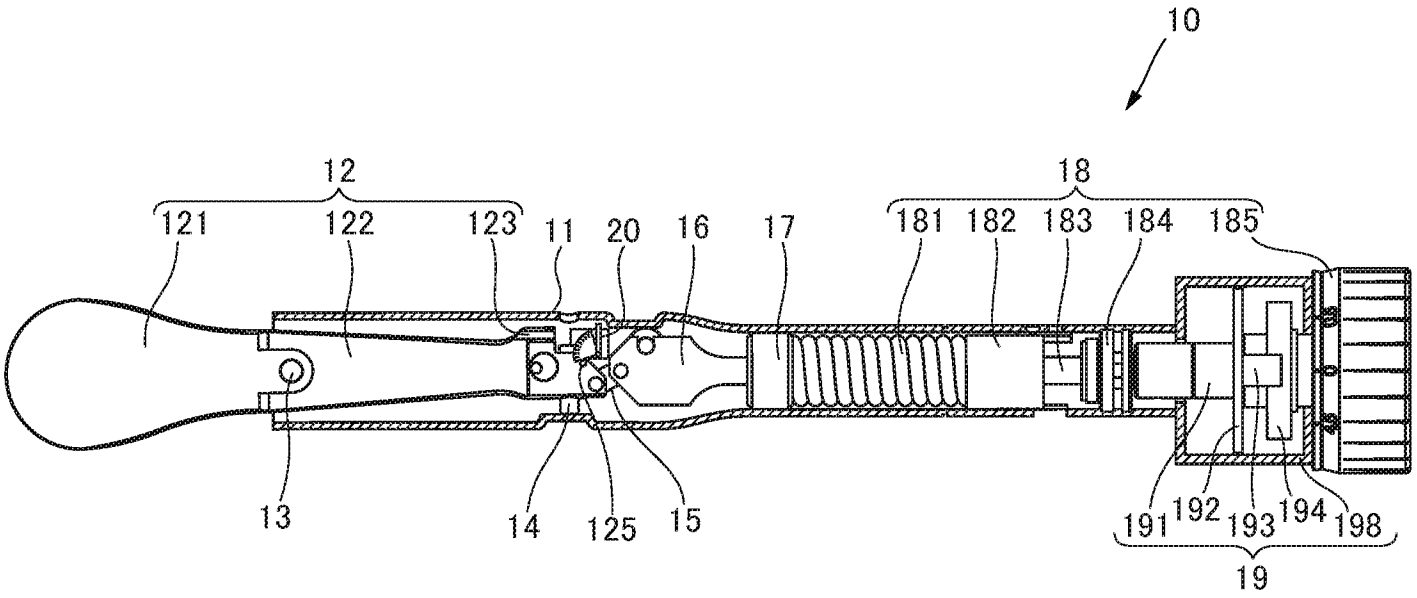
FIG. 4 is a partial cross-sectional view illustrating the internal structure of the torque wrench illustrated in FIG. 1.

FIG. 4 is a partial cross-sectional view illustrating the internal structure of the torque wrench 10. In order to illustrate the internal structure of the torque wrench 10, FIG. 4 illustrates the cross-section of only the casing 11 and a housing 198 of the rotation angle detector 19. As illustrated in FIG. 4, the casing 11 accommodates the head 12, a gain adjustment screw 14, a linkage 15, a slider 16, a spring guide 17, the torque value setting unit 18, and the rotation angle detector 19 which constitute the torque wrench 10. In addition, the casing 11 includes a turn detector 20 configured to detect the motion of the casing 11 with respect to the head 12.

The head 12 having an approximately rod shape includes an arm 122, a contact portion 123 and a motion detecting pin 125 which are accommodated in the casing 11, and the ratchet head 121 exposed to the outside of the casing 11. The casing 11 and the head 12 are pivotally supported by the head pin 13 provided at the boundary between the rachet head 121 and the arm 122 to turn with respect to one another.

The head 12 is pivotally supported by the head pin 13 in the casing 11. Therefore, when the casing 11 turns around the head pin 13 in the rotating direction of the tightened member, the position of the arm 122 is changed relative to the casing 11.

The contact portion 123 is provided at one end of the arm 122 which is opposite to the ratchet head 121 side. When the casing 11 turns, the arm 122 contacts the inner wall of the casing 11, so that a clicking noise and a vibration are produced from the torque wrench 10. The contact portion 123 is provided at the position in which the casing 11 contacts the arm 122 when a load of the tightening operation is applied to the head 12.

The gain adjustment screw 14 is provided at the one end of the arm 122 of the head 12 to penetrate the head 12 in the width direction of the head 12. The gain adjustment screw 14 is provided to adjust the gain of the motion of the arm 122 when a tightening torque is applied to the torque wrench 10. The arm 122 is provided with the linkage 15 which is connected to the slider 16 by a link mechanism.

Like the contact portion 123, the motion detecting pin 125 is provided at the one end of the arm 122 opposite to the ratchet head 121 side in the longitudinal direction. The motion detecting pin 125 is provided to protrude in the thickness direction of the head 12, that is, the direction orthogonal to the page of FIG. 4. The motion detecting pin 125 is provided to allow the turn detector 20 to detect the turn of the casing 11.

One end of the slider 16 is connected to the arm 122 via the linkage 15, and the other end of the slider 16 is connected to the spring guide 17. The slider 16 moves in the casing 11 in the longitudinal direction when the casing 11 turns with respect to the head 12. In addition, the slider 16 includes a roller contacting the inner wall of the casing 11. The roller guides the movement of the slider 16 in the casing 11.

The spring guide 17 is an approximately cylindrical member. The cylindrical spring guide 17 is disposed in the casing 11 such that the casing 11 and the spring guide 17 have the same axis. The spring guide 17 guides the motion of a spring 181 of the torque value setting unit 18 The spring guide 17 includes a hole formed at the center of one flat surface of the spring guide. The other end of the slider 16 is inserted into the hole of the spring guide 17. The other flat surface of the spring guide 17 contacts one end of the spring 181.

The torque setting unit 18 includes the spring 181, a torque value display 182, a setting bolt 183, and a lock nut 184 which are provided in the casing 11. In addition, the torque value setting unit 18 includes a torque value setting grip 185 disposed outside the casing 11. The torque value setting unit 18 is configured to be able to set the preset torque value to any value by rotating the torque value setting grip 185 to change the compressive force of the spring 181.

The spring 181 is a compression spring which is compressed in the longitudinal direction of the torque wrench 10. The spring 181 may be, for example, a coil spring. As described above, the one end of the spring 181 contacts the other flat surface of the spring guide 17. The head 12 is pressed by the compressive force of the spring 181 via the linkage 15, the slider 16, and the spring guide 17. The spring 181 presses the head 12 pivotally supported by the head pin 13 in the casing 11, and therefore to restrict the casing 11 from turning with respect to the head 12.

The torque value display 182 having an approximately cylindrical shape is disposed in the casing 11. One end of the torque value display 182 contacts the other end of the spring 181, and the other end of the torque value display 182 is disposed to face the torque value setting grip 185. The torque value display 182 displays a scale indicating the preset torque value on its surface. A baffle (not illustrated) is attached to the inner wall of the casing 11 The torque value display 182 is provided to be able to slide with respect to the baffle in the axial direction of the torque wrench 10. The baffle prevents the torque value display 182 from turning in the casing 11, and allows the torque value display 182 to move in the casing 11 in the axial direction. By this means, it is possible to always read the scale of the torque value display 182 from a display window formed in the casing 11. Moreover, an internal thread is provided to penetrate the center of the torque value display 182 in the longitudinal direction.

The setting bolt 183 screws the internal thread of the torque value display 182. A flange of the setting bolt 183 engages with the lock nut 184.

The lock nut 184 having an approximately disk shape is fixed in the casing 11. A hole is formed in the center of the lock nut 184. The shaft of the setting bolt 183 is inserted into the hole of the lock nut 184.

The torque value setting grip 185 having an approximately cylindrical shape is provided at one end of the torque wrench 10. The torque value setting grip 185 functions as a rotating member. The torque value setting grip 185 is connected to the setting bolt 185 via the rotation angle detector 19 to rotate the setting bolt 183.

<Motion of Torque Wrench>

Now, the motion of the torque wrench 10 will be described. Here, a case in which the worker tightens the tightened member with a predetermined tightening torque value will be described as an example.

When the torque value setting grip 185 is rotated, the setting bolt 183 is rotated with the torque value setting grip 185. When the setting bolt 183 is rotated, the torque value display 182 moves in the casing 11 to compress the spring 181, so that the compressive force of the spring 181, that is, the preset torque value is changed. The worker checks that the torque value displayed on the torque value display 182 is the preset torque value, and stops the rotation of the torque value setting grip 185. After that, the worker performs the tightening operation.

Figure 5:
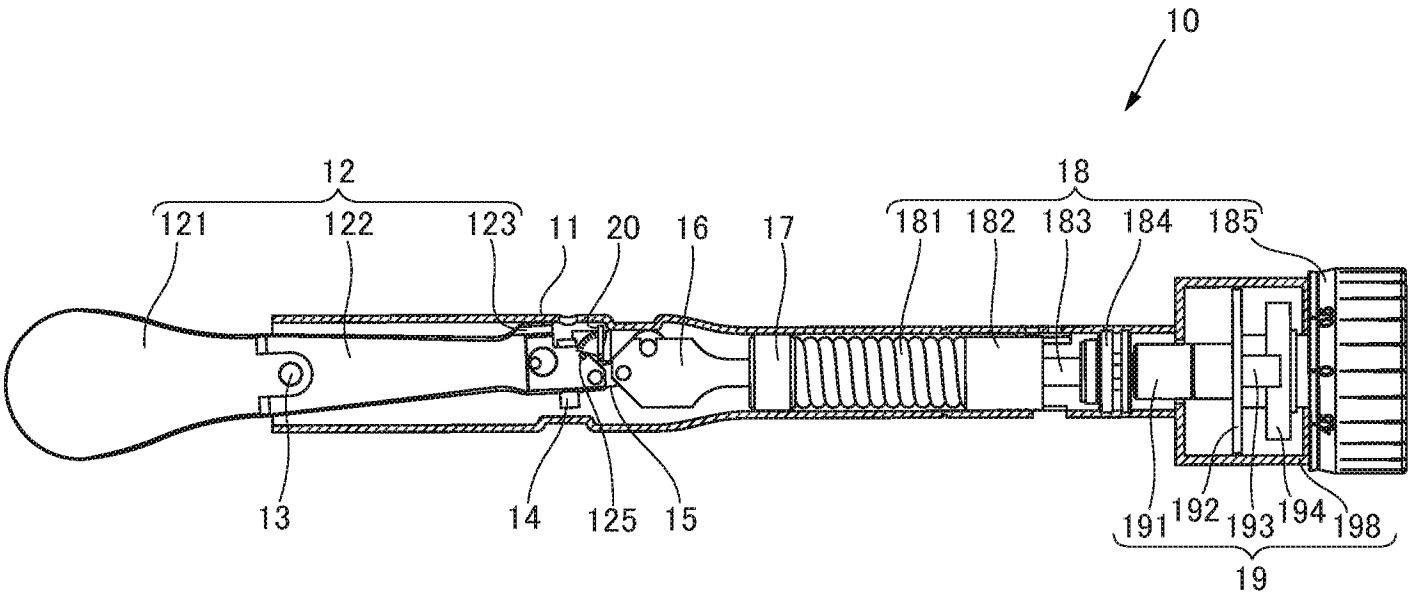
FIG. 5 is a partial cross-sectional view illustrating the internal structure of the torque wrench illustrated in FIG. 1 when a load applied to the torque wrench is equal to or greater than a preset torque value.

FIG. 5 is a partial cross-sectional view illustrating the internal structure of the torque wrench 10 when a load applied to the torque wrench 10 is equal to or greater than the preset torque value. As illustrated in FIG. 5, when the tightened member is tightened by the torque wrench 10, the compressive force is applied from the spring 181 to the head 12 via the slider 16 and the linkage 15. When the tightening torque reaches the preset torque value set by the torque value setting unit 18, a force generated by the tightening torque exceeds the compressive force of the spring 181. At this time, the casing 11 and the slider 16 are released from the restriction by the spring 181, so that the state of the torque wrench 10 illustrated in FIG. 4 is changed to the state illustrated in FIG. 5. To be more specific, the casing 11 is turned around the head pin 13 in the tightening direction (first direction), and contacts the arm 122 of the head 12, so that a clicking noise and a vibration are produced. With the clicking noise and the vibration, the torque wrench 10 notifies the worker that the tightening torque reaches the preset torque value. Upon perceiving the clicking noise and the vibration, the worker understands that the tightening torque reaches the preset torque value, and then stops applying the force to the torque wrench 10. As a result, the casing 11 is turned in the loosening direction (second direction).

The casing 11 is turned around the head pin 13, and therefore the inner wall of the casing 11 contacts the contact portion 123 When the inner wall of the casing 11 contacts the contact portion 123, the torque wrench 10 produces a clicking noise and a vibration.

<Configuration of Rotation Angle Detector>

The rotation angle detector 19 includes the housing 198, and a rotating shaft 191, a substrate 192, an encoder unit 193 and a disk 194 accommodated in the housing 198.

The rotating shaft 191 is connected to the setting bolt 183 and the torque value setting grip 185 illustrated in FIG. 4 to be able to cooperate with them. The rotating shaft 191 transfers the torque from the torque value setting grip 185 rotated by the worker to the setting bolt 183.

The substrate 192 is a member on which electronic components such as the encoder unit 193, a calculation unit 31, and a communication unit 32 can be placed. A well-known electronic circuit substrate such as a printed circuit board may be used as the substrate 192. The rotating shaft 191 is inserted into a hole formed in the substrate 192.

The encoder unit 193 includes a light emitting element 193*a*, a light receiving element 193*b*, and a signal processor 193*c* described later. As the encoder unit 193, an absolute encoder or an incremental encoder, which is well-known as a rotary encoder, may be used.

<Functional Block of Rotation Angle Detector>

Figure 6:
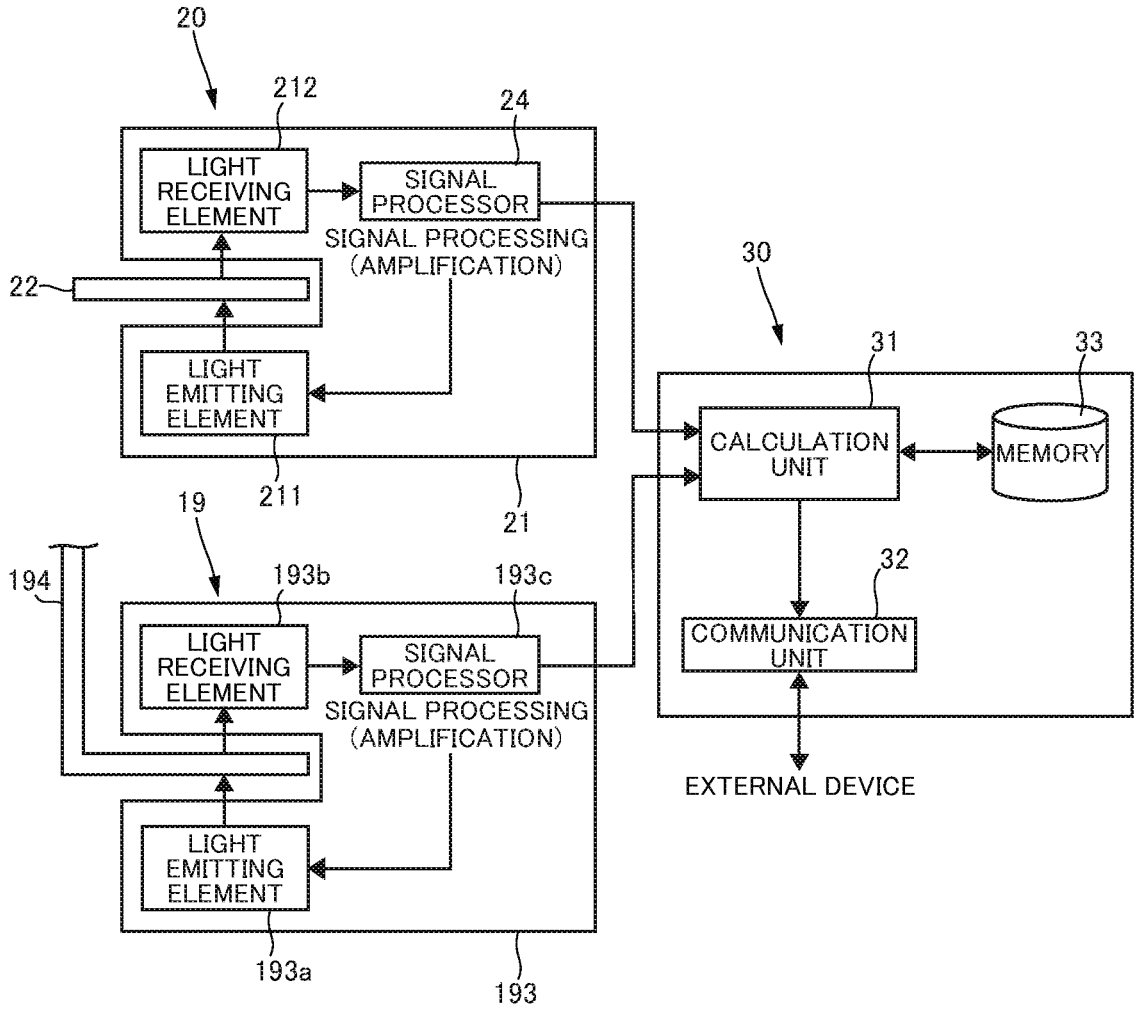
FIG. 6 is a block diagram illustrating a rotation angle detector and a turn detector of the torque wrench illustrated in FIG. 1.

FIG. 6 is a block diagram illustrating the rotation angle detector 19 and the turn detector 20 of the torque wrench 10. Here, the function of the turn detector 20 will be described later. As illustrated in FIG. 6, the rotation angle detector 19 is connected to an MCU (micro control unit) 30 The MCU 30 performs the calculation of the preset torque value set by the torque value setting unit 18 of the torque wrench 10, and the calculation for the turning motion of the casing 11 with respect to the head 12 detected by the turn detector 20 described later.

Next, components constituting the rotation angle detector 19 will be described. As the light emitting element 193*a*, various types of light sources such as a light emitting diode and a laser diode may be used. The light emitting element 193*a* functions as a light emitter configured to emit light to the disk 194.

As the light receiving element 193*b*, for example, a photo diode may be used. The light receiving element 193*b* functions as a light receiver configured to receive part of the light emitted from the light emitting element 193*a*, which has not been varied, for example, has not been reflected, blocked or refracted by the disk 194. The light receiving element 193*b* outputs a light reception signal based on the received light.

The signal processor 193*c* performs signal processing, for example, amplifies the light reception signal outputted from the light receiving element 193*b*, detects the rotation angle of the setting bolt 183, and outputs information on the rotation angle (hereinafter "rotation angle information") which is electronic information based on the detected rotation angle of the setting bolt 183 to the calculation unit 31. In addition, in order to save the electric power and stabilize the motion of the light emitting element 193*a*, the signal processor 193*c* may control the electric power to drive the light emitting element 193*a* and the motion of the light emitting element 193*a*, based on, for example, the amount of light received.

The rotating shaft 191 penetrates the center of the disk 194, and rotates with the disk 194. The disk 194 functions as a light reception varying unit configured to vary the light receiving state of the light receiving element 193*b*.

The disk 194 varies the light receiving state of the light receiving element 193*b* by preventing the light from the light emitting element 193*a* from passing therethrough. The disk 194 having an approximately cup-like shape includes a disk-shaped flat plate, a side portion provided around the outer periphery of the flat plate, and light permeable portions formed on the side portion. The flat plate and the side portion of the disk 194 have light impermeability (light blocking effect). The light permeable portions are formed as slits on the side portion at regular intervals to allow the light from the light emitting element 193*a* to pass therethrough.

Here, the disk 194 is not limited to the above-described light permeable type having the light permeable portions. For example, a prism is applicable to refract the light from the light emitting element 193*a*, so that it is possible to vary the light receiving state of the light receiving element 193*b*.

<Calculation Based on Rotation Angle Information>

Next, the calculation of the preset torque value performed by the calculation unit 31 based on the rotation angle information outputted from the rotation angle detector 19 will be described. The calculation unit 31 calculates the rotation angle (the number of rotations and the amount of rotation) of the setting bolt 183, based on the signal outputted from the signal processor 193*c* of the encoder unit 193. In addition, the calculation unit 31 calculates the preset torque value set by the torque value setting grip 185, based on the rotation angle of the setting bolt 183. The calculation unit 31 pays attention to the change in the compressive force of the spring 181 depending on the rotation angle of the setting bolt 183, and calculates the preset torque value set by the torque value setting unit 18, based on the detected rotation angle of the setting bolt 183.

The calculation unit 31 calculates the preset torque value by using information indicating the correlation between the rotation angle stored in a memory 33 and the preset torque value (for example, a conversion formula or a data table for calculating the preset torque value based on the rotation angle), and outputs the calculated preset torque value. The calculation unit 31 may output the calculated preset torque value associated with the information on the time and date of the work, the worker and so forth.

<Configuration of Turn Detector (1)>

The turn detector 20 is provided in the vicinity of the motion detecting pin 125, that is, one end of the arm 122 opposite to the ratchet head 121 side in the longitudinal direction. The turn detector 20 is fixed to the casing 11 to detect the motion of the casing 11 with respect to the head 12, specifically, the arm 122 of the head 12. The turn detector 20 may be provided in the casing 11. At least part of the turn detector 20 may be exposed from the casing 11. In this case, the exposed part of the turn detector 20 may be covered with a cover (not illustrated).

Figure 7:
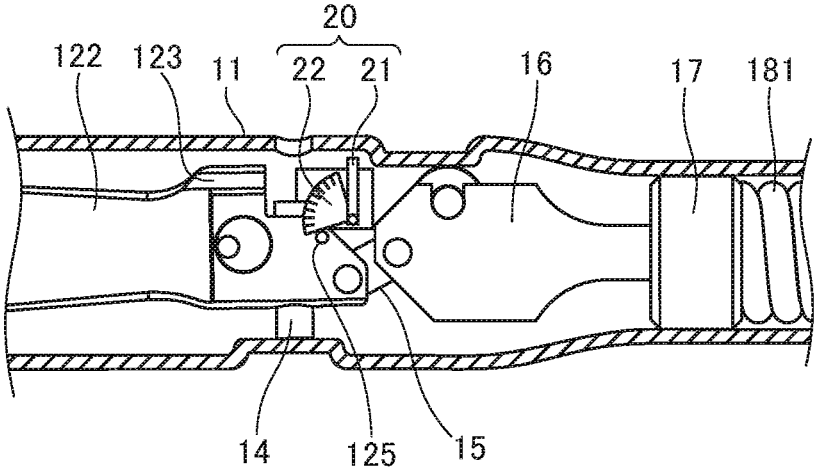
FIG. 7 is a schematic view illustrating the turn detector of the torque wrench illustrated in FIG. 1.

FIG. 7 is a schematic view illustrating the turn detector 20 of the torque wrench 10. As illustrated in FIG. 7, the turn detector 20 includes an encoder unit 21 including a light emitting element and a light receiving element, and a detection lever 22. The turn detector 20 detects information on the turn (the turn direction and the amount of turn) of the casing 11, based on the variation in the light receiving state of the light receiving element of the encoder unit 21, that is, the amount of light received by the light receiving element of the encoder unit 21.

<Functional Block of Turn Detector>

As illustrated in FIG. 6, the turn detector 20 is connected to the MCU 30, like the rotation angle detector 19. The MCU 30 performs the calculation for the turning motion of the casing 11 of the torque wrench 10.

Next, components constituting the turn detector 20 will be described. As a light emitting element 211, various types of light sources such as a light emitting diode and a laser diode may be used. The light emitting element 211 functions as a light emitter configured to emit light to a light receiving element 212 and the detection lever 22.

As the light receiving element 212, for example, a photo diode may be used. The light receiving element 212 is disposed to be able to receive the light from the light emitting element 211, for example, at a position facing the light emitting element 211 The light receiving element 212 functions as a light receiver configured to receive part of the light emitted from the light emitting element 211, which has been varied, for example, reflected, blocked, or refracted by the detection lever 22. The light receiving element 212 outputs a light reception signal based on the received light.

The detection lever 22 is a light permeable member made of, for example, acrylic, provided between the light emitting element 211 and the light receiving element 212. A number of prisms are provided on the side surface of the detection lever 22 at regular intervals, and configured to refract the light from the light emitting element 212 and pass the light therethrough.

Figure 8:
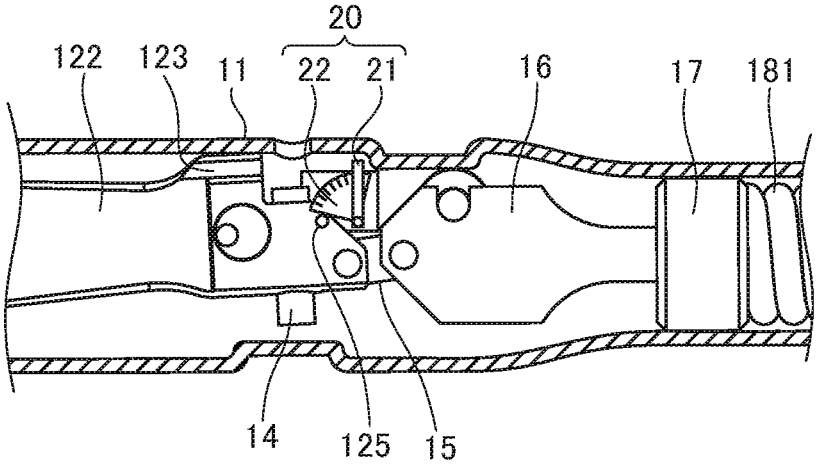
FIG. 8 is a schematic view illustrating the turn detector of the torque wrench illustrated in FIG. 1 when a load applied to the torque wrench is equal to or greater than the preset torque value.

FIG. 8 is a schematic view illustrating the turn detector 20 when a load applied to the torque wrench 10 is equal to or greater than the preset torque value. As illustrated in FIG. 8, the detection lever 22 turns around a pivot. By this means, the detection lever 22 varies the light receiving state of the light receiving element 212 depending on the positions of the prims when the light passes through the prisms. That is, the detection lever 22 functions as a light reception varying unit configured to vary the light receiving state of the light receiving element 212, depending on the differences in position of the prisms when the light emitted from the light emitting element 211 passes through the detection lever 22 and is refracted.

The detection lever 22 contacts the motion detecting pin 125, and therefore synchronizes with the motion of the head 12 having the motion detecting pin 125. That is, the detection lever 22 synchronizes with the motion of the motion detecting pin 125, and therefore the turn detector 20 can acquire the information on the turning motion such as the amount of turn, the turn direction, and the turn angle of the casing 11 with respect to the head 12.

Here, the detection lever 22 is not limited to the above-described type having prisms, but may vary the light receiving state of the light receiving element 212 by, for example, providing a light permeable member and a light impermeable member to block the light from the light emitting element 193*a*.

A signal processor 24 processes, for example, amplifies the light reception signal outputted from the light receiving element 212. At this time, the signal processor 24 detects the amount of turn of the detection lever 22, based on the difference in the light receiving state of the light receiving element 212, which is caused by the detection lever 22. The calculation unit 31 can calculate the amount of turn, the turn angle, and the turn direction of the casing 11 with respect to the head 12 having the motion detecting pin 125, based on the detected amount of turn of the detection lever 22.

In addition, the signal processor 24 outputs electronic information on the amount of turn based on the detected amount of turn of the motion detecting pin 125, to the calculation unit 31. Moreover, in order to save the electric power and stabilize the motion of the light emitting element 211, the signal processor 24 may control the electric power to drive the light emitting element 211 and the motion of the light emitting element 211, based on, for example, the amount of light received.

<Calculation Based on Information on Amount of Turn>

Now, the calculation for the turning motion of the casing 11 performed by the calculation unit 31 will be described. This calculation is performed based on the information on the amount of turn outputted from the turn detector 20. The calculation unit 31 calculates the amount of turn (turn angle) of the casing 11 with respect to the head 12, based on the signal outputted from the signal processor 24 of the encoder unit 21.

Based on information on the threshold to determine that the amount of turn of the casing 11 is the same as that stored in the memory 33 (hereinafter "click detection ON"), the calculation unit 31 outputs a signal indicating "click detection ON."

Figure 9:
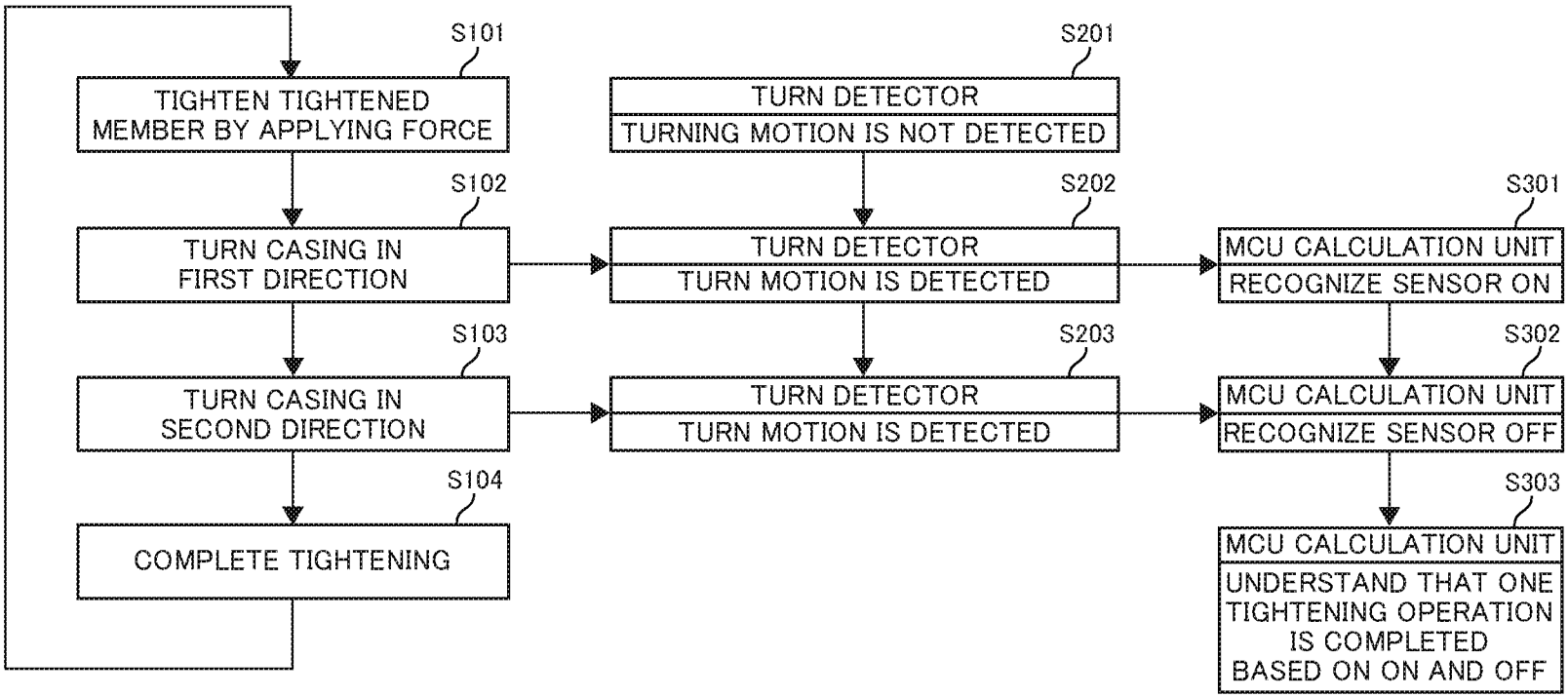
FIG. 9 is a flowchart illustrating a process of detecting a tightened member being tightened, which is performed by the turn detector illustrated in FIG. 6.

FIG. 9 is a flowchart illustrating a process of detecting the tightened member being tightened, which is performed by the turn detector 20. FIG. 9 describes the operation of the worker to tighten the tightened member such as a bolt and a nut by using the torque wrench 10 with the tightening torque of the preset torque value. When the tightened member is tightened with the torque wrench 10 by applying the force of the worker (S101), the head 12 and the casing 11 of the torque wrench 10 are located in the positions in the state where the torque of the torque wrench 10 does not exceed the preset torque value as illustrated in FIG. 4 and FIG. 7. At this time, the turn detector 20 does not detect the turning motion of the casing 11, and therefore not output information on the amount of turn (S201).

As illustrated in FIG. 5 and FIG. 8, when the load applied to the torque wrench 10 is equal to or greater than the preset torque value, the casing 11 and the slider 16 are released from the restriction by the spring 181 and moves from the state illustrated in FIG. 4 to the state illustrated in FIG. 5. In this state, the casing 11 turns around the head pin 13 with respect to the arm 122 of the head 12 in the first direction. The motion detecting pin 125 provided on the arm 122 is also moved with respect to the casing 11 (S102).

At this time, the detection lever 22 of the turn detector 20 is pressed by the motion detecting pin 125, and therefore the light receiving state of the light receiving element 212 attached to the casing 11 is varied. The turn detector 20 senses the motion detecting pin 125, and therefore detects the turning motion of the casing 11. If the amount of turn of the casing 11 is equal to or greater than a predetermined value, the calculation unit 31 determines that the casing 11 is turned with respect to the head 12 (bending state).

The information on the amount of turn from the turn detector 20 is outputted to the calculation unit 31 of the MCU 30 via the signal processor 24 (S202).

The calculation unit 31 of the MCU 30 can recognize the turning motion of the casing 11, based on the information on the amount of turn outputted from the turn detector 20 (S301).

After the casing 11 is turned around the head pin 13 with respect to the arm 122 of the head 12 in the first direction and released from the force of the worker, the casing 11 turns in the loosening direction (second direction). The casing 11 is returned from the position as illustrated in FIGS. 5 and 8 to the position as illustrated in FIG. 4 and FIG. 7 (S103).

At this time, the detection lever 22 of the turn detector 20 is also returned to the position illustrated in FIG. 7, and therefore the light receiving state of the light receiving element 212 is varied, so that the turn detector 20 can detect the turning motion of the casing 11 (S203).

The calculation unit 31 of the MCU 30 recognizes that the positional relationship between the casing 11 and the head 12 comes back to the original state illustrated in FIG. 4, based on the information on the amount of turn outputted from the turn detector 20 (S302).

When the tightening torque to tighten the tightened member reaches the preset torque value, the user completes the tightening operation by using the torque wrench 10 (S104). When determining that the casing 11 has turned with respect to the head 12 in both the first direction and the second direction, based on the information on the amount of turn received from the turn detector 20, the calculation unit 31 of the MCU 30 understands that one tightening operation is completed (S303).

As described above, the turn detector 20 can acquire the amount of turn, the turn direction, and the turn angle based on the information on the amount of turn of the casing 11, and therefore the torque wrench 10 can correctly recognize the tuning motion. In addition, the torque wrench 10 can improve the traceability of the tightening operation and the analysis of the work, by using the information on the amount of turn, the turn direction, and the turn angle of the turning motion of the casing 11 which is acquired by the turn detector 20.

In addition, the turn detector 20 of the torque wrench 10 acquires information on the change in positional relationship between the head 12 and the casing 11 as the information on the amount of turn. By this means, the torque wrench 10 does not need to set the initial positions of the detection devices such as the light emitting element, the light receiving element, and the detection lever 22 of the turn detector 20 in response to the change over time since the torque wrench 10 was assembled or used for the first time. By this means, the torque wrench 10 can correctly recognize the positional relationship between the head 12 and the casing 11, improve the ease of assembly, and facilitate the maintenance.

Next, a process of detecting the deterioration of the spring 181 performed by the calculation unit 31 will be described. This process is performed base on the information on the amount of turn of the casing 11 which is acquired by the turn detector 20.

If the spring 181 deteriorates, for example, is worn out or damaged, the load applied by the spring 181 is reduced. Therefore, the slider 16 moves to the second end of the casing 11 of the torque wrench 10. This change in the position of the slider 16 causes the casing 11 to move with respect to the arm 122 of the head 12 in the first direction (downward in FIG. 4), and also causes the motion detecting pin 125 to move in the second direction.

The torque wrench 10 can detect the position of the motion detecting pin 125 by the motion detector 20, so that the calculation unit 31 can recognize the deterioration of the spring 181, for example, the spring 181 is worn out, or damaged.

The calculation unit 31 functions as a tool condition determination unit configured to determine the condition of deterioration of the spring 181 based on the amount of turn of the casing 11 That is, the calculation unit 31 compares the information on the amount of turn acquired from the flowchart illustrated in FIG. 9 with the information on the amount of turn stored in the memory 33, and then estimates and calculates the variation in the load of the spring 181. Here, the information indicating the relationship between the amount of turn and the deterioration of the spring 181 is, for example, a conversion formula and a data table used to calculate the relationship between the amount of turn of the detection lever 22 and the load of the spring 181. When the calculation unit 31 outputs the signal indicating "click detection ON", and calculates and outputs the condition of deterioration of the spring 181, the output may include the information on the date and time of the work, and the worker.

When the estimated load of the spring 181 reaches a predetermined value, for example, the load of the spring 181 in the serviceability limit state which is prestored in the memory 33, the calculation unit 31 notifies the worker of that fact by producing a clicking noise or using the display.

As described above, the torque wrench 10 can detect the condition of deterioration of the spring 181, based on the information on the amount of turn of the casing 11 acquired from the turn detector 20. Here, the torque wrench 10 can detect that the position of the tip of the gain adjustment screw 14 moves, which means that the gain adjustment screw 14 loosens as the condition of the deterioration, based on the information on the amount of turn of the casing 11. In addition, the torque wrench 10 can also detect the wear and the deformation of the portion of the casing 11 contacting the gain adjustment screw 14 as the condition of deterioration, based on the information on the amount of turn of the casing 11.

The communication unit 32 transmits information about the work to tighten the tightened member, including either the data on the preset torque value outputted from the calculation unit 31 or the information on the turn angle, to an external device such as an information processor (not illustrated) The communication path of the communication unit 32 may be wireless or wired. Moreover, the type of the communication format of the communication unit 32 with the external device is not limited. For example, Bluetooth (trademark), infrared communication, WAN (wide area network), and LAN (local area network) are applicable.

Here, the calculation performed by the above-described MCU 30 may be performed by an external device, for example, any kind of computer, instead of the torque wrench 10. In this case, the information on the rotation angle outputted from the rotation angle detector 19, and the information on the amount of turn outputted from the turn detector 20 are transmitted from the communication unit 32 to the above-described computer. Then, the computer may perform the calculation of the preset torque value, and the calculation for the turning motion of the casing 11 In this case, the computer may output the result of the calculation, or transmit the result of the calculation to the torque wrench 10, and the torque wrench 10 may output the result of the calculation. By this means, it is possible to realize a tool condition determination system of the torque wrench 10 with the external computer.

<Configuration of Turn Detector (2)>

Figure 10:
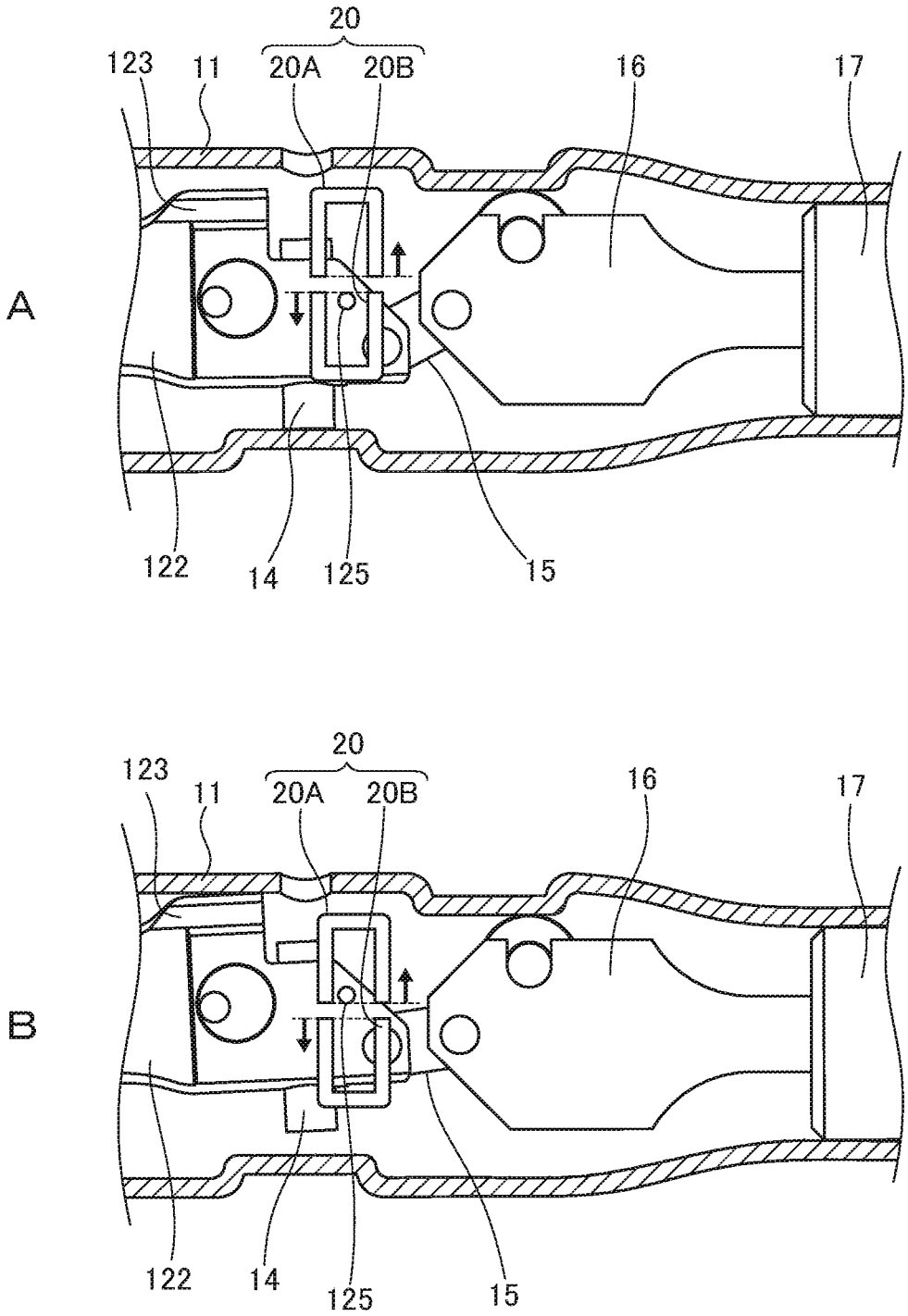
FIG. 10 is a schematic view illustrating another example of the turn detector of the torque wrench illustrated in FIG. 1.

FIG. 10 is a schematic view illustrating another example of the turn detector 20 of the torque wrench 10. As illustrated in FIG. 10, the turn detector 20 may be composed of a first turn detector 20A configured to detect the turn of the casing 11 in the first direction, and a second turn detector 20 configured to detect the turn of the casing 11 in the second direction, which are light emitting and receiving devices.

FIG. 10A illustrates the first turn detector 20A and the second turn detector 20B of the torque wrench 10 when the load applied to the torque wrench 10 is lower than the preset torque value. As illustrated in FIG. 10A, when the load is lower than the preset torque value, the motion detecting pin 125 is located within the detectable range of the second turn detector 20B.

FIG. 10B illustrates the first turn detector 20A and the second turn detector 20B when the load of the torque wrench 10 is equal to or greater than the preset torque value. When the load applied to the torque wrench 10 is equal to or greater than the preset torque value, the casing 11 turns in the first direction, so that the motion detecting pin 125 gets out of the detectable range of the second turn detector 20B and falls within the detectable range of the first turn detector 20A. At this time, the light receiving state of the light receiving element of the second turn detector 20B is varied, and therefore the second turn detector 20B outputs a signal.

After that, the casing 11 turns in the second direction to move from the state illustrated in FIG. 10B back to the state illustrated in FIG. 10A. At this time, the motion detecting pin 125 moves from the detectable range of the first turn detector 20A to the detectable range of the second turn detector 20B. The light receiving state of the light receiving element of the first turn detector 20A is varied during the emission of the light, and therefore the first turn detector 20A outputs a signal. The calculation unit 31 of the MCU 30 can calculate the turn direction of the casing 11 with respect to the head 12, based on the state of signals outputted from the first turn detector 20A and the second turn detector 20B. In addition, the calculation unit 31 can calculate the amount of turn and the turn angle of the casing 11 with respect to the head 12 from the outputted signal, based on the information on the detection ranges of the first turn detector 20A and the second turn detector 20B in association with the amount of turn and the turn angle of the casing 11.

As described above, it is possible to accurately detect the turning motion of the casing 11 with respect to the head 12 by using the first turn detector 20A and the second turn detector 20B.

<Configuration of Turn Detector (3)>

Figure 11:
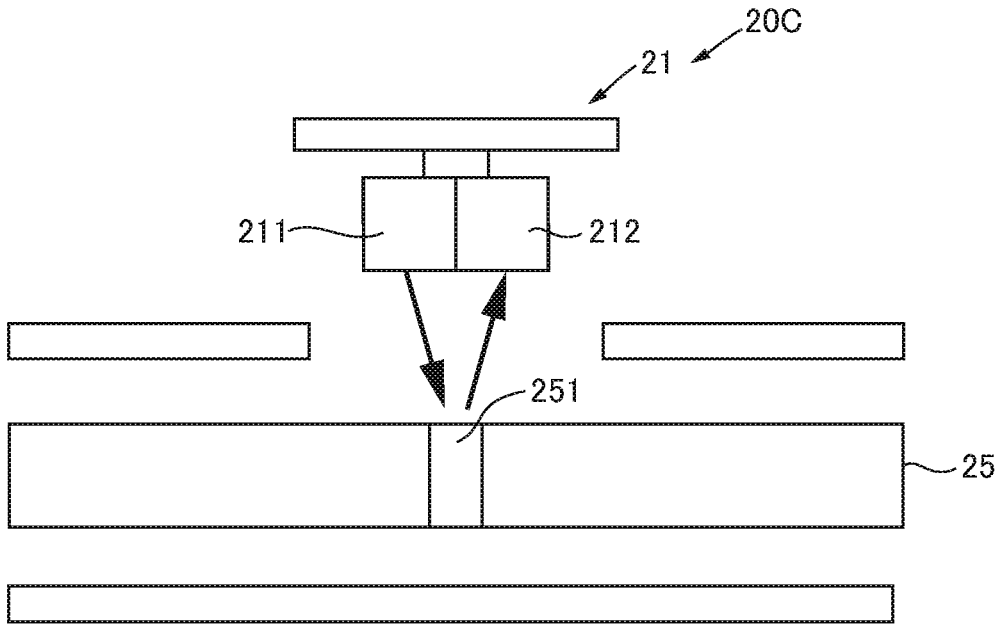
FIG. 11 is a schematic view illustrating further another example of the turn detector of the torque wrench illustrated in FIG. 1.

FIG. 11 is a schematic view illustrating a further another example of the turn detector 20 of the torque wrench 10. As illustrated in FIG. 11, a turn detector 20C employs a light reception varying unit 25 having a plurality of holes 251 that allow the light to pass therethrough provided at regular intervals, instead of the detection lever 22. Only part of the light emitted from the light emitting element 211 which has been reflected by the light reception varying unit 25 can be received by the light receiving element 212, but the light emitted from the light emitting element 211 which has passed through the holes 251 cannot be received by the light receiving element 212. The turn detector 20C detects the turn of the casing 11 in the first direction and the second direction, based on the light receiving state of the light receiving element 212.

As described above, it is possible to accurately detect the turning motion of the casing 11 with respect to the head 12 by the turn detector 20C.

<Configuration of Turn Detector (4)>

Figure 12:
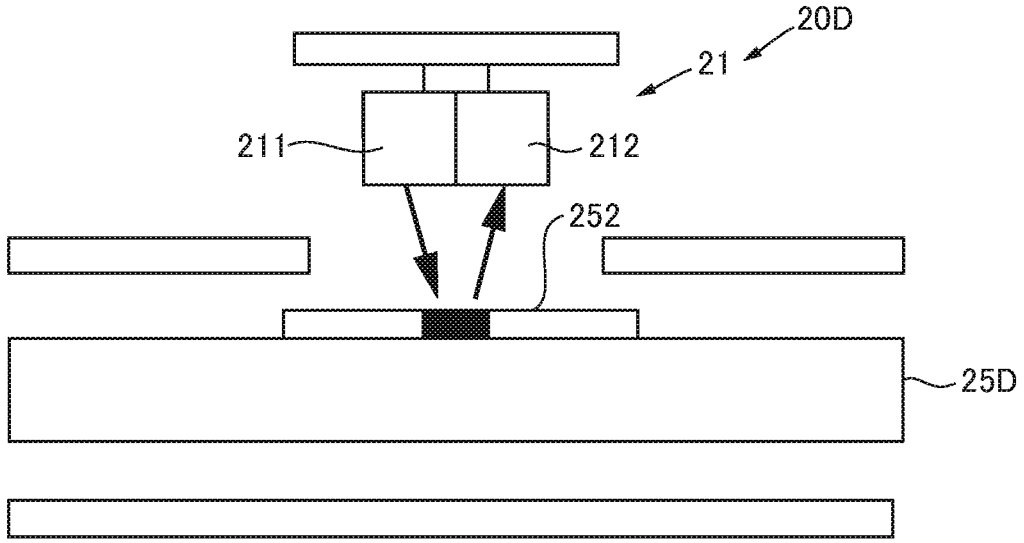
FIG. 12 is a schematic view illustrating further another example of the turn detector of the torque wrench illustrated in FIG. 1.

FIG. 12 is a further another example of the turn detector 20 of the torque wrench 10. As illustrated in FIG. 11, a turn detector 20D employs a light reception varying unit 25D having a reflection seal 252 that reflects light. The light receiving element 212 receives part of the light emitted from the light emitting element 211. That is, the light receiving element 212 receives the light which has been reflected by the reflection seal 252, but does not receive the light reflected by other portions such as the light reception varying unit 25D. The turn detector 20D detects the turning motions of the casing 11 in the first direction and the second direction, based on the light receiving state of the light receiving element 212.

As described above, it is possible to accurately detect the turning motions of the casing 11 with respect to the head 12 by the turn detector 20D.

Here, the light reception varying unit 25 of the turn detector 20 is not limited to the above-described example. The turn detector 20 may detect the variation in the light receiving state of the light receiving element by using another means, such as laser making and printing to vary the surface of the light receiving element.

The invention claimed is:

1. A tightening tool comprising:

a main body configured to be able to be held by a worker and including a turn detector;

a head having an approximately rod shape and provided in the main body, the head being able to engage with a tightened member;

a head pin configured to pivotally support the head in the main body to turn the main body with respect to the head; and a spring configured to restrict the main body from turning with respect to the head by a compressive force in a compressive direction which is the same as a longitudinal direction of the head, wherein when a tightening torque for tightening the tightened member reaches a preset torque value, the main body is released from restriction by the spring to turn around the head pin in a first direction and then turn in a second direction, the turn detector detects turns of the main body with respect to the head in the first direction and the second directions;

the turn detector includes:

a light emitter configured to emit light;

a light receiver configured to receive the light from the light emitter; and a detection lever configured to vary a light receiving state of the light receiver;

the detection lever turns in synchronization with a motion of the head; and the turn detector, based on the variation in the light receiving state of the light receiver, acquires information on a change in positional relationship between the head and the main body as information on an amount of turn.

2. The tightening tool according to claim 1, further comprising a tool condition determination unit configured to determine a condition of deterioration of the spring, based on a turn of the main body detected by the turn detector.

3. The tightening tool according to claim 1, wherein the turn detector further includes:

a first turn detector configured to detect a turn of the main body in the first direction; and a second turn detector configured to detect a turn of the main body in the second direction.

4. The tightening tool according to claim 1, further comprising a torque value setting unit configured to be able to set the preset torque value to a predetermined value by rotating a rotating member to change the compressive force of the spring.

* * * * *